US009950552B2

(12) United States Patent
Van Den Berg

(10) Patent No.: US 9,950,552 B2
(45) Date of Patent: Apr. 24, 2018

(54) IDENTITY DOCUMENT COMPRISING A GHOST IMAGE BASED ON A TWO-DIMENSIONAL IMAGE

(71) Applicant: MORPHO B.V., Haarlem (NL)

(72) Inventor: Jan Van Den Berg, Gouda (NL)

(73) Assignee: MORPHO B.V., Haarlem (NL)

( * ) Notice: Subject to any disclaimer, the term of this patent is extended or adjusted under 35 U.S.C. 154(b) by 0 days.

(21) Appl. No.: 14/654,761

(22) PCT Filed: Dec. 4, 2013

(86) PCT No.: PCT/NL2013/050872

§ 371 (c)(1),
(2) Date: Jun. 22, 2015

(87) PCT Pub. No.: WO2014/098572

PCT Pub. Date: Jun. 26, 2014

(65) Prior Publication Data

US 2015/0360501 A1 Dec. 17, 2015

(30) Foreign Application Priority Data

Dec. 21, 2012 (NL) ..... 2010045

(51) Int. Cl.
*B42D 25/309* (2014.01)
*B42D 25/00* (2014.01)
*B42D 25/29* (2014.01)

(52) U.S. Cl.
CPC ..... *B42D 25/309* (2014.10); *B42D 25/00* (2014.10); *B42D 25/29* (2014.10); *B42D 2035/06* (2013.01); *B42D 2035/20* (2013.01); *B42D 2035/44* (2013.01); *B42D 2035/50* (2013.01)

(58) Field of Classification Search
CPC ..... B42D 25/309
USPC ..... 283/77
See application file for complete search history.

(56) References Cited

U.S. PATENT DOCUMENTS

2003/0183695 A1* 10/2003 Labrec ..... B42D 25/00 283/77
2008/0284157 A1* 11/2008 Muke ..... B42D 25/00 283/77
2010/0177094 A1 7/2010 Kaule et al.

FOREIGN PATENT DOCUMENTS

DE 10 2007 029204 A1 1/2009
EP 2 466 345 A1 6/2012
WO 2006/110038 A2 10/2006
WO 2011/015384 A1 2/2011
WO 2011/122943 A1 10/2011
WO WO 2011122943 A1 * 10/2011 ..... B42D 25/00

OTHER PUBLICATIONS

International Search Report, dated Jan. 31, 2014, from corresponding PCT application.

* cited by examiner

*Primary Examiner* — Kyle Grabowski
(74) *Attorney, Agent, or Firm* — Young & Thompson

(57) ABSTRACT

An identity document includes in a single plane a two-dimensional image and under optical elements a ghost image for verifying the authenticity of the two-dimensional image. The ghost image is a stereo image and the stereo image is based on the two-dimensional image. The stereo image includes at least two images of the person on the identity card wherein at least one of the two images is a calculated image. The stereo image may further include a floating image, the floating image being arranged to be perceived to float over the ghost image.

6 Claims, 2 Drawing Sheets

IDENTITY DOCUMENT COMPRISING A GHOST IMAGE BASED ON A TWO-DIMENSIONAL IMAGE

FIELD OF THE INVENTION

The present invention relates generally to identity documents, and more in particular, to an identity document having a photo of a person and items for verification, to ensure the authenticity of the photo and the identity document.

BACKGROUND OF THE INVENTION

It is known to create on an identity document an image by producing two or more images of an object from different angles. By providing in the image such two images, a viewer of the image perceives a stereo image of the object shown.

An identity document of this type is disclosed in WO 2006/110038 (A2) wherein an authentication mark comprising two or three images that are engraved by laser light through a lens structure in a sensitive layer. By tilting the identity document at a different angle, one of the images can always be seen. The angle at which the different images are applied is −27°, 0° and +27° respectively. This provides added security for an identity document such as a passport, driving license and the like. However, for the user, i.e. the person checking the identification document, it is not always clear that such different images are present. Moreover, at certain checkpoints there is little time to check all the authentication marks in an identity document, as a result of which checking for the presence of the different images is overlooked. Consequently, the authentication marks are not always optimally used under normal circumstances.

An further identity document disclosed in applicant's WO 2011/122943 (A1) describing how an image with two rotated images can be obtained from a photo image by means of projection in an image processing device with the aid of special software. The rotation images are being applied in an interlaced manner under linear lenses in order to form a stereoscopic portrait image for use in a security or identification document.

A disadvantage of the known structure is that the stereographic perception may be adversely effected through calculation of the rotated images, and that images calculated in this way are thereby less suitable for use in security and identification documents such as passports, driving licenses, access badges, etc. Therefore, the authenticity of a three-dimensional image of this type is difficult to establish on visual inspection.

It is an object of this invention to provide an identity document, from which the photo can be easily authenticated. Accordingly it would be desirable to overcome or ameliorate at least one of the disadvantages of the prior art.

SUMMARY OF THE INVENTION

The object is achieved by the identity document comprising the two-dimensional image and the ghost image on a single image plane according to claim 1.

According to the invention, an identity document comprising in a single plane a two-dimensional image and under optical means a ghost image for verifying the authenticity of the two-dimensional image, wherein the ghost image is a stereo image and the stereo image is based on the two-dimensional image.

Advantageously, the identity document will provide quick verification of the authenticity of the two-dimensional image on visual inspection, where the stereo image should be visible without tilting the identity document while the stereo image is compared with the two-dimensional image. The identity document of the invention comprising in a single plane the two-dimensional image and under optical means the ghost image also provides an indication of the authenticity at the same time, in that since the ghost image is based on the two-dimensional image, a further verification is provided that the identity document has not been tampered with. The invention thus will improve the verification of the authenticity of the identity document.

It should be noted that the stereo image comprises at least two images of a person of the two-dimensional image and in that the stereo image comprises images based on the two-dimensional image at least two different angles with respect to the person in the two-dimensional image.

According to the present invention, the stereo image comprises at least two images of the person on the identity card wherein at least one of the two images is a calculated image.

Advantageously, when inspecting the identity document, a user verifying the identity document will always be inclined to study the images applied thereon of the face of the bearer of the identity document. When the identity document is inspected, the user will immediately recognize that the two-dimensional image and the stereo image correspond to the same person without having to perform any operation, such as touching, tilting or put the identity document against the light for checking the authenticity of the two-dimensional image. If there is any difference between the two-dimensional image and the stereo image, it would become immediately evident to the user or if there is an error between the images, this will be recognizable to the user at first sight. This action will occur as a reflex, and after this action the user can proceed to inspect the identity document in more detail.

In a preferred embodiment of the invention, the stereo image comprises at least two images of the person on the identity card of which at least one of the two images is a calculated image.

Advantageously, only one image should be taken from the bearer of the identity document, while the other image will be derived from calculation. This option can reduce cost since no stereophotography is required.

According to the present invention, the at least one of the two images is a rotated image over an angle in the range from about 4.5° to about 7.5°, preferably over an angle of about 6°. Moreover, the angle of rotation can be in the range from about −4.5° to about −7.5°, preferably over an angle of about −6°.

According to an aspect of the invention, a rotation angle difference between two consecutive rotated images in the stereographic ghost image is about 4°. These consecutive images refer to images that are being applied relative to each other.

Advantageously, an accurate ghost image can be obtained for use in identity documents from only one single conventional two-dimensional basic image.

According to an aspect of the invention, the stereo image consist of more than two images.

As a result, the quality of the stereo image could be increased. Moreover, the risk of the unique characteristics of the image being lost through calculation is substantially reduced.

According to an aspect of the present invention, the optical means comprise a series of linear lenticular lenses forming a lens array and said lenses are cylindrical shaped or spherical shaped.

Additionally, the images are being applied interlaced. Furthermore, the interlaced images are being applied offset relative to one another and overlapping one another in an image layer.

It is of further advantage in the present invention that by having the images overlapping one another in an image layer, the accuracy and effectiveness of the stereo image on visual inspection is increased.

In a preferred embodiment of the invention, the images are overlapped with respect to each other in such a way that for a user the angle of observation between different images is between about 6° and 15°.

Advantageously, such a viewing angle at a normal viewing distance of about 30-90 cm allows a simple verification of a stereo effect in the ghost image by the user. Also, a natural representation of the human face of the person is obtained which is highly suitable for identification purposes. As a result, the stereo image is easily detectable by the user.

In an embodiment, the stereo image further comprises a floating image, the floating image being arranged to be perceived to float over the ghost image. Such an additional image that floats over the ghost image can serve as additional security mark or authenticity code. Several codes are possible, for example the code can comprise a date of birth of the bearer of the identity document.

Preferably, the security mark will be selected from but not limited to digits and/or letters.

It should be noted that the floating image would be relatively small in relation to the ghost image. Also, the floating image could be arranged to appear to move backward and forward (or left to right) relative to the ghost image when the ghost image is viewed from different angles. As a result, an additional authenticity characteristic is formed in the image, helping to establish the authenticity and/or uniqueness of the ghost image and the identity document. Additionally, the floating image can assist the user to distinguish the stereo effect of the ghost image more easily.

It should further be noted that the European patent publication EP 2.466.345 A1 discloses an identification document showing two images of a same person. One of the images comprises a structure selected from the group of diffraction grating, hologram, and a light-scattering structure having anisotropic light-scattering properties. In the aforementioned cases the light is scattered in many directions, essentially providing an unsharp image of the person contained in the respective image. By contrast, the present invention seeks to provide an image that remains sharp within the range of intended viewing distances.

Additionally, the German patent publication DE 10 2007 029 204 A1 discloses a security document comprising a motif image that is subdivided into a plurality of cells, wherein in each of the cells imaged regions of the motif image are arranged. The motif image is a three-dimensional image comprising an arrangement of substantially identical spherical microlenses to provide a Moiré magnifier effect to the motif image. It should however be noted that the present invention does not seek to provide an image with Moiré-effects, because such effects will also render the corresponding image of a person's face unclear.

BRIEF DESCRIPTION OF THE DRAWINGS

Other aspects, features and details of the present invention will be readily understood by reference to the following detailed description of preferred embodiments, taken in conjunction with the drawings and the appended claims. In the appended drawings:

DETAILED DESCRIPTION OF EMBODIMENTS

Figure 1:
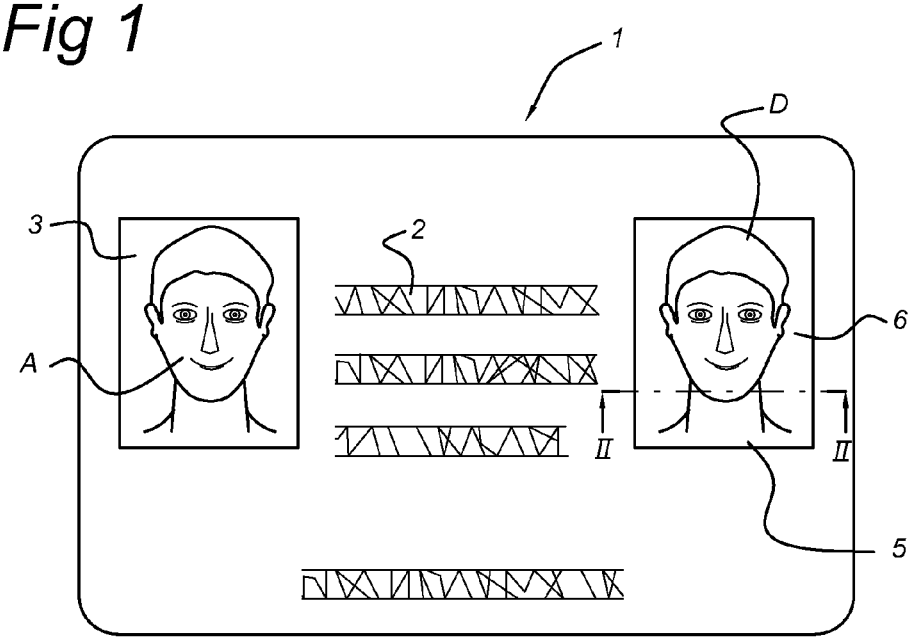
FIG. 1 diagrammatically shows an identity document according to an embodiment of the invention.

FIG. 1 shows an embodiment of an identity document in its entirety comprising a data medium 1 having image layer 11, data 2 and two images A, D. The data 2 that are associated with the document bearer, may comprise data or codes readable by human or by a machine. Moreover, the two images A, D are positioned parallel to each other in the same image plane. The images correspond to a two-dimensional basic image A and a ghost image D. The two-dimensional basic image A is basically a photograph 3 of a person. The ghost image D is a stereo image 5, based on the two-dimensional basic image A of the same face of the person to obtain a stereo effect. The ghost image D is applied under a lens array 7, the lens array 7 being formed by lenses 8, 9, 10 extending in the direction of the symmetry axis of the face of the person. The stereo image 5 consist of a composite image 6. The ghost image D comprises at least two images A, B being applied offset relative to one another and overlapping one another in an image layer 11. An optical layer comprising a light-permeable material and forming a lens array 7 is applied to the image layer 11. The at least two images A, B are arranged in such a way that when viewed from different angles with both eyes and at certain viewing distance to the data medium 1, the at least two images A, B are visible with a depth effect (stereo effect). The at least two images A, B comprise images of the same identical person's face observed at different rotation angles. The at least two images A, B are arranged in such a way and the lenses of the lens array are made in such a way that the distance between said different angles is between about 6°-15°, and wherein the at least two images are on a single image plane. When the ghost image D is viewed by a user, the user is able to see one image of the at least two with the right eye and another image of them with the left eye. As a result, an image with the stereo effect is perceived by the user. The distance between the user's eyes as well as the viewing distance for example, between 30-90 cm, will play a role on the accuracy and effectiveness of the visual inspection.

It should be noted that the person shown in the two-dimensional basic image A is the same as the person shown in the stereo image D, and that the stereo image D is based on the two-dimensional basic image A. The ghost image D may comprise the two-dimensional basic image A per se or an image derived from the calculation of the two-dimensional basic image A as a first image, and at least a second image derived from a calculation of the two-dimensional basic image A.

Alternatively, two or more images can be used. These images can be calculated from the two-dimensional image or created by stereo-photography.

Figure 2:
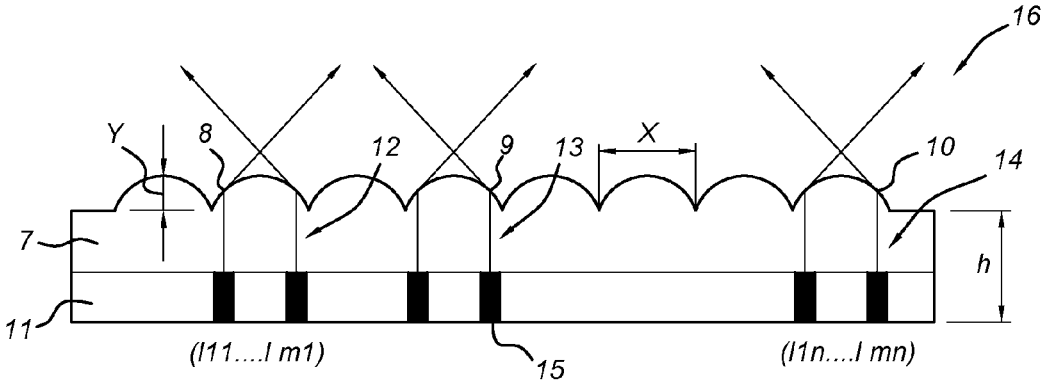
FIG. 2 shows a transversal cross section of the ghost image of FIG. 1 along the line II-II.

FIG. 2 shows a transversal cross section of an embodiment of the ghost image D of FIG. 1 along the line II-II, wherein the stereo image D is applied onto an image carrier 16. The stereo image D is here represented by means of a series of a linear cylindrical or spherical lenses 8, 9, 10. The image carrier 16 can be used for constructing composite images on different types of identification documents e.g. security documents, national identity cards, driving licenses, bank passes, passports, visa stickers, etc. The image carrier 16 comprises the lens array 7 which is provided on the upper side with a series of n linear lenses 8, 9, 10. The number of lenses n is, for example, 130 lenses per cm.

In FIG. 2 the image layer 11 is shown which is located under of the lens array 7, in which each of the groups of image lines 12, 13, 14 is applied in such a way that each of said groups comprise image elements, in a form of a pixel, being burned via a laser into the image layer 11.

It will be appreciated that each image line of the group of image lines 12, 13, 14 is formed by vertical areas of carbonized image layer material, i.e., polycarbonate, that are formed in places where the laser beam has been focused by the lenses 8, 9, 10 on the image layer 11. The image lines 12, 13, 14 comprise a plurality of image lines 15 provided under the lenses 8, 9, 10. Furthermore, each group of image lines 12, 13, 14 comprises m lines (l11, l21 . . . lm1), . . . , (l1*n*, l2*n*, . . . lmn), wherein the image lines m may be between 2 and 60. Each image line group 12, 13, 14 is deflected by the associated lens 8, 9, 10 in a predefined direction to the user.

Figure 3:
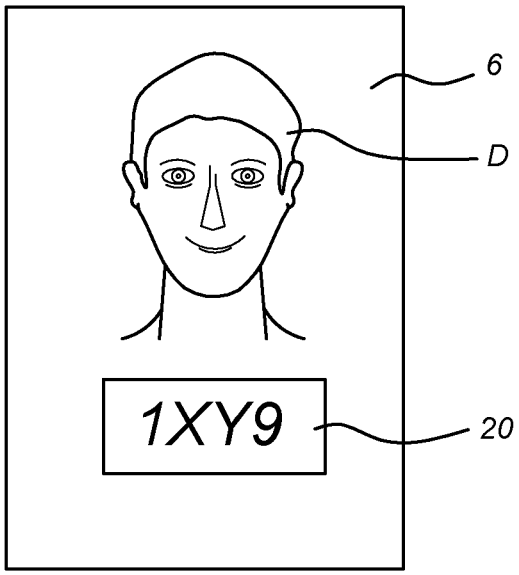
FIG. 3 shows a further embodiment of the ghost image

FIG. 3 shows an embodiment of the ghost image D in which a floating image 20, such as a security mark or authenticity code, is applied to each composite image 6 from which the stereo image D is constructed. In the formed stereo image D, the floating image 20 is located in front of the composite image 6 of the person. The floating image 20 can be applied with an image processing unit in each case in two-dimensional form in the image area, for example on certain position below the facial form. The floating image 20 is superpositioned on each of the at least two images A, B, in such a way, that when the identity document is tilted, the floating image 20 appears to move relative to the ghost image D. The floating image 20 may comprise a code comprising digits, letters, or symbols. Also, the floating image may comprise a patterned image of any conceivable shape.

The images that are calculated from the two-dimensional photo can be processed and created by a computing device as known in the art that has been loaded with suitable software.

In the light of the above, variants will be immediately apparent to those skilled in the art that are obvious in the light of the above description and fall within the scope of the appended claims.

The invention claimed is:

1. An identity document (1) comprising:

in a single plane a two-dimensional portrait image (A) and under optical means a ghost image (D) for verifying authenticity of the two-dimensional portrait image (A), wherein the ghost image (D) is a stereo image (5) that is based on the two-dimensional portrait image (A), wherein the ghost image (D) comprises the two-dimensional portrait image (A) per se, wherein the two-dimensional portrait image (A) shows a person, and the ghost image (D) shows a person being the same person as shown by the two-dimensional portrait image (A), wherein the ghost image (D) comprises more than two images of the person on the identity document (1) of which at least one of the more than two images is a calculated image that is rotated over an angle in the range from 4.5° to 7.5°, the more than two images being interlaced, and a floating image (20) arranged to appear to float over the ghost image (D), wherein the optical means comprise a series of linear lenticular lenses (8, 9, 10) forming a lens array (7) and said lenses (8, 9, 10) are cylindrical shaped, the lenses (8, 9, 10) extending in the direction of the symmetry axis of the face of the person, the images being formed by focusing a laser beam via the lenses and a carbonizing image layer material, and wherein the two dimensional portrait image (A) and the stereo image are recognizable as the same person and can be compared by an inspecting person without tilting the identity document for establishing authenticity of the two-dimensional portrait image (A).

2. The identity document (1) according to claim 1, wherein the ghost image (D) is made under two different angles with respect to the person in the two-dimensional portrait image (A).

3. The identity document (1) according to claim 1, wherein the rotation angle difference between the at least two interlaced images is 4°.

4. The identity document (1) according to claim 1, wherein the more than two images are offset relative to one another and overlapping one another in an image layer (11).

5. The identity document (1) according to claim 1, wherein the more than two images are overlapped with respect to each other in such a way that the angle of observation of different images is 6° to 15°.

6. The identity document (1) according to claim 1, wherein the floating image (20) comprises digits and/or letters.

* * * * *